United States Patent [19]

Benedict

[11] Patent Number: 4,585,127

[45] Date of Patent: Apr. 29, 1986

[54] EXTENDABLE CLOSET ORGANIZERS

[75] Inventor: Charles E. Benedict, Tallahassee, Fla.

[73] Assignee: Benedict Engineering Co., Inc., Tallahassee, Fla.

[21] Appl. No.: 654,341

[22] Filed: Sep. 25, 1984

[51] Int. Cl.[4] ..... A47F 7/08

[52] U.S. Cl. ..... 211/34; 211/94

[58] Field of Search ..... 211/34, 94, 162, 118, 211/113, 105.3, 35, 38, 182; 248/298, 74.3, 58, 60

[56] References Cited

U.S. PATENT DOCUMENTS

| | | | |
|---|---|---|---|
| D. 277,248 | 1/1985 | Benedict . | |
| D. 277,436 | 2/1985 | Benedict . | |
| D. 280,045 | 8/1985 | Benedict . | |
| D. 280,046 | 8/1985 | Benedict . | |
| D. 280,047 | 8/1985 | Benedict . | |
| D. 280,048 | 8/1985 | Benedict . | |
| D. 280,049 | 8/1985 | Benedict . | |
| D. 280,575 | 9/1985 | Benedict . | |
| D. 280,785 | 10/1985 | Benedict . | |
| 1,415,316 | 5/1922 | Corbin . | |
| 2,359,372 | 10/1944 | Leader | 211/35 X |
| 2,569,761 | 10/1951 | Hibbs . | |
| 2,917,185 | 12/1959 | Kovacs . | |
| 2,985,311 | 5/1961 | Abel . | |
| 3,124,253 | 3/1964 | Petrich . | |
| 3,160,279 | 12/1964 | Hovey | 211/94 X |
| 3,331,513 | 7/1967 | Cappelli | 211/34 |
| 3,335,872 | 8/1967 | Dodich . | |
| 3,389,807 | 6/1968 | Manning et al. . | |
| 3,552,576 | 1/1971 | Lahr . | |
| 3,954,182 | 5/1976 | McEvers | 211/105.3 X |
| 4,008,807 | 2/1977 | Phillips . | |
| 4,524,937 | 6/1985 | Lizan | 248/74.3 |

FOREIGN PATENT DOCUMENTS

| | | | |
|---|---|---|---|
| 903739 | 6/1972 | Canada | 248/60 |
| 1038226 | 9/1953 | France | 248/74.3 |
| 817045 | 7/1959 | United Kingdom | 248/74.3 |

OTHER PUBLICATIONS

Western Electric Technical Digest No. 26, Apr. 1972, p. 33, Strap Retainer and Method of Utilization in Forming Exchange Cables.

*Primary Examiner*—Ramon S. Britts
*Assistant Examiner*—Sarah A. Lechok Eley
*Attorney, Agent, or Firm*—Dowell & Dowell

[57] ABSTRACT

Suspended garment and/or shoe bags are mounted to an extendable or telescoping support member which is mounted to a clothing rod in a closet by a hanger bar which is carried by the telescoping member so as to be extendable generally perpendicularly with respect to the elongated axis of the clothing rod so that the garment and/or shoe bags are selectively displayed in an area spaced outwardly of any other articles of clothing which may be suspended from the clothing rod.

2 Claims, 7 Drawing Figures

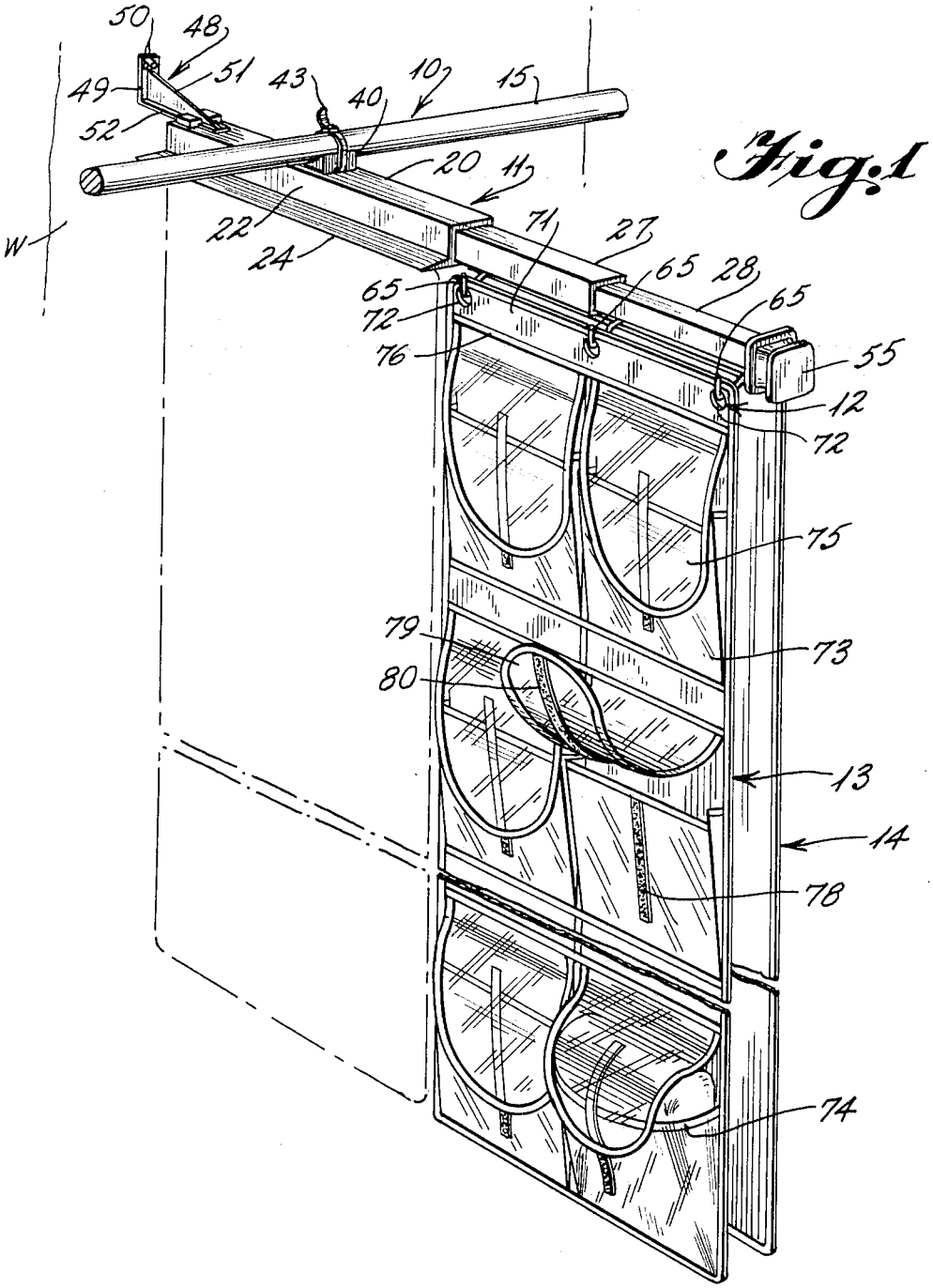
Fig. 1
Fig. 3
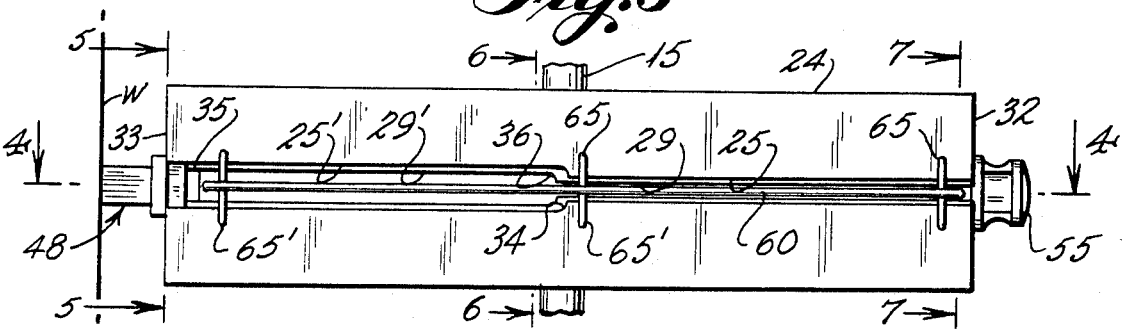

EXTENDABLE CLOSET ORGANIZERS

REFERENCE TO RELATED APPLICATIONS

This application is related to applicant's co-pending design applications, Ser. Nos. 453,052 and 453,053 filed Dec. 27, 1982 and entitled TELESCOPING TIE RACK and TELESCOPING TIE RACK WITH COVER and to an application for patent filed concurrently herewith entitled MULTIPLE SUPPORT HANGING GARMENT ORGANIZERS.

BACKGROUND OF THE INVENTION

1. Field of the Invention

This invention is generally directed to closet organizers and particularly to garment and/or shoe bags which are telescopically supported in suspended relationship to the clothes rod in a closet by way of a hanger member having two rows of spaced hooks thereon for simultaneously supporting a pair of such garment and/or shoe bags in back-to-back relationship and which hanger is moveable carried by the telescoping elements of an extendible support member which is secured to the clothes rod.

2. History of the Prior Art

There have been numerous developments made in the field of storage hangers and racks for closets and other storage areas. One problem associated with creating compact storage space is the identification of articles which are stored. The more articles which are stored in a given location, the greater the difficulty in locating a particular item.

In an effort to make stored items more readily accessible, use has been made of various storage racks which have telescoping components. The telescoping features of these racks makes it easier to locate stored items as such items may be moved relative to other stored articles in a particular location.

In clothes closets, one means by which space has been saved is through the use of clothing bags and shoe bags capable of storing a plurality of clothing items in separate pockets on the bags. Most of these clothing and/or shoe bags are directly supported either on a wall or door or are suspended on conventional clothes hangers from the clothes rod in a closet. When it is desired to obtain an article from a conventional support bag which is suspended from a clothes rod, it is either necessary to lift the entire bag from suspended engagement with the rod or to urge the bag from adjacent articles of clothing. The more crowded the closet, that is, the more items that are suspended from the support rod, the more difficult the task of removing or storing articles in the clothing bags.

In U.S. Pat. No. 4,008,807 to Phillps, a display device is disclosed wherein articles of clothing or shoes are carried on a plurality of panel members which are slideably extendable from a box-like support or cabinet member. Such bulky and complex storage facilities are not economically suitable for ordinary home closet use and would consume more space than they would save. A similar display unit is disclosed in U.S. Pat. No. 3,552,376 to Lahr.

In applicant's co-pending design applications, Ser. Nos. 453,052 and 453,053, filed Dec. 27, 1982, extendable racks similar to that of the present invention are shown having hanger members for supporting a plurality of belts, ties or similar articles. The racks are telescopically movable so as to orient the ties and belts outwardly away from the clothes rod so as to be readily accessbile to an individual. Other telescoping racks for such personal articles as belts, ties and the like are disclosed in McEvers U.S. Pat. Nos. D 273,645, 3,945,182 and 3,897,122; Manning et al., 3,389,807; Petrich 3,124,253; Dodich 3,335,872; Kovacs 2,917,185; Abil 2,985,311; Corbin 1,415,316 and Hibbs 2,569,761. These racks, however, have limited use for storing various types of garments and other wearing apparel. In addition, these patents do not appreciate the need to provide multiple vertically oriented storage means in a single telescoping rack.

SUMMARY OF THE INVENTION

This invention is directed to a selectively displayable closet organizer including garment and/or shoe bags having a plurality of individual article storage pockets and which bags are suspended from a telescoping member of an extendable support rod by a hanger having two rows of spaced hook members which are oppositely oriented with respect to one another. The hanger includes two upstanding end portions which are keyed so as to be cooperatively and securely supported within the telescoping member of the extendable support rod. The extendable support rod is mounted in suspended relationship to the clothes rod in a closet and is telescopically movable perpendicularly with respect thereto so as to selectively orient the garment and/or shoe bags outwardly into the passageway of the closet.

It is a primary object of this invention to provide a garment and/or shoe organizer which will permit a plurality of clothing articles to be compactly stored in a vertically suspended position beneath the clothing rod in a closet but which are easily accessible by urging the organizers outwardly with respect to the closet walls so as to selectively orient the articles of clothing into an area where they are displayed and may be readily removed from their stored position.

It is yet another object of the present invention to provide a closet organizer which permits articles of clothing and shoes to be suspended from the clothes rod in a closet adjacent other suspended articles of clothing but which organizer permits the stored articles to be selectively supported outwardly of the other articles of clothing so as to be readily accessible.

It is still a further object of the present invention to permit a substantial number of clothing articles to be stored in a relatively narrow vertical space within a closet by means of a telescoping support member which permits the stored articles to be selectively supported in cantilevered relationship with respect to the closet clothes rod without requiring structural modifications to the closet or without the need to provide a floor supported system.

It is another object of the invention to provide a combination telescoping hanger assembly and garment storage bag clothing organizer wherein a pair of garment and/or shoe storage bags may be simultaneously supported from a single extendable support member which is secured to the clothes rod in a closet so as to be telescopically movable with respect thereto.

BRIEF DESCRIPTION OF THE DRAWINGS

FIG. 1 is an illustrational view of one embodiment of the closet organizer of the present invention as it is supported in telescopic relationship with respect to a clothes rod in a closet and showing the normal orientation of the organizer in dotted line.

FIG. 3 is a bottom plan view of the hanger and telescoping rod member of the present invention.

DESCRIPTION OF THE PREFERRED EMBODIMENT

Figure 2:
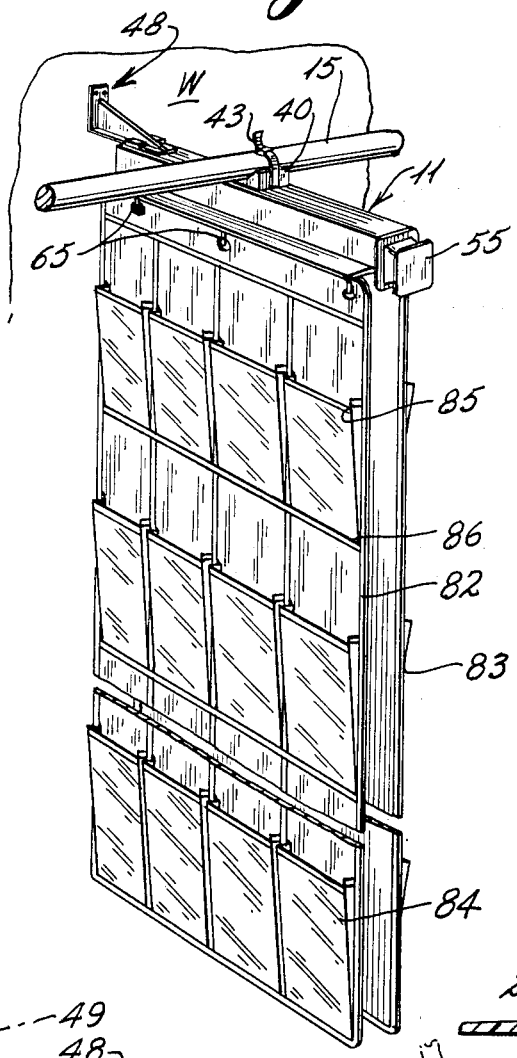
FIG. 2 is an illustrational view of the closet organizer of the present invention showing another embodiment of article storage bags.
Figure 5:
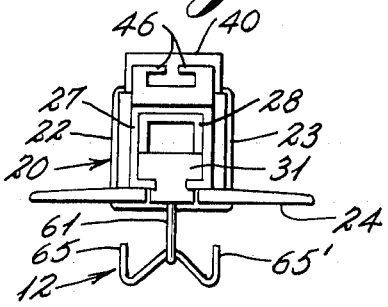
FIG. 5 is a cross sectional view taken along line 5—5 of FIG. 3.
Figure 6:
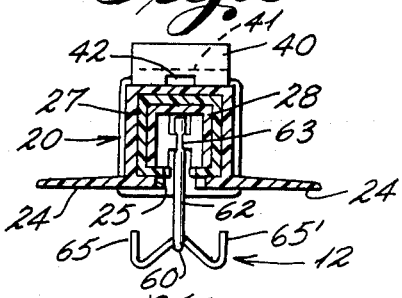
FIG. 6 is a cross sectional view taken along line 6—6 of FIG. 3.

With continued reference to the drawings, the extendable closet organizer 10 of the present invention is shown in FIG. 1 to include a telescoping support rod member 11, hanger bracket 12 and clothing organizer bags 13 and 14, respectively. The garment organizer is particularly adapted to be mounted to a clothes rod 15 which extends generally horizontally and in parallel spaced relationship with the rear wall W of the closet. Generally, the garment bags 13 and 14 are suspended beneath the clothes hanger rod 15 as shown in dotted line configuration in FIG. 1, however, the bags are positionable in cantilevered fashion outwardly with respect to the wall W by selectively telescoping the support rod member 11 to the position shown in full line in FIG. 1. When the support rod member is fully extended, the clothing bags 13 and 14 are readily viewable and easily assessible.

The telescoping rod member 11 and hanger bracket are shown in greater detail in FIGS. 3–7. The telescoping support rod 11 includes an elongated outer housing 20 having an upper wall 21, side walls 22 and 23 and outwardly flared lower wall portions 24. An elongated slot or opening 25 is provided along the length of the lower wall portion 24 in order to permit the hanger bracket to be disposed therethrough as will be described in greater detail hereinafter. Slidably mounted with the exterior housing is an intermediate telescoping member 27 and an interior telescoping member 28. Both the intermediate and the interior telescoping members have generally rectilinear cross sections and are shown as being of a dimension to slideably engage one another with the intermediate member being slideably engaged between the outer housing 20 and the inner telescoping member 28. An elongated slot 30 is provided along the length of the lower portion of the inner telescoping member 28.

In order to limit the movement of the intermediate slide member 27 with respect to the outer housing 20, the rear end wall thereof 31 is enlarged so as to extend downwardly with the slot 25 provided along the length of the outer housing. With particular reference to FIG. 3, the channel or slot 25 is shown as having a first width from the front 32 toward the rear wall 33 of the outer housing. Intermediate its length, the slot 25 becomes wider as shown at 25'. The enlarged end wall 31 of the intermediate slide member 27 extends downwardly into sliding engagement with the walls defining the enlarged slot 25' so that as the enlarged end member contacts the area at which the narrow portion of the slot 25 begins, the enlarged end member will abut the inwardly tapering wall portions of the slot generally designated at 34. In this manner, the intermediate telescoping member 27 is limited so as to extend only half way of its length from the forward end 32 of the outer housing. The limited extension of the intermediate portion of the telescoping rod member insures that a sufficient portion of the intermediate slide member is retained within the outer housing so as to rigidly support the outwardly extending portion thereof in cantilevered fashion with respect to the clothes hanging rod 15.

In order to limit the axial displacement of the inner telescoping member with respect to the intermediate portion, the innermost sliding member is likewise provided with an enlarged end wall 35 which extends downwardly into the slot 29 provided along the length of the intermediate slide member 27. The slot 29 also includes an enlarged rear portion shown at 29' which forms a track in which the enlarged end wall 35 of the inner slide member is slidingly received. Movement of the inner sliding member is restricted when the end wall thereof contacts the inwardly extending walls 36 which unite the wide portion 29' of the slot with the narrow portion 29 thereof.

Figure 4:
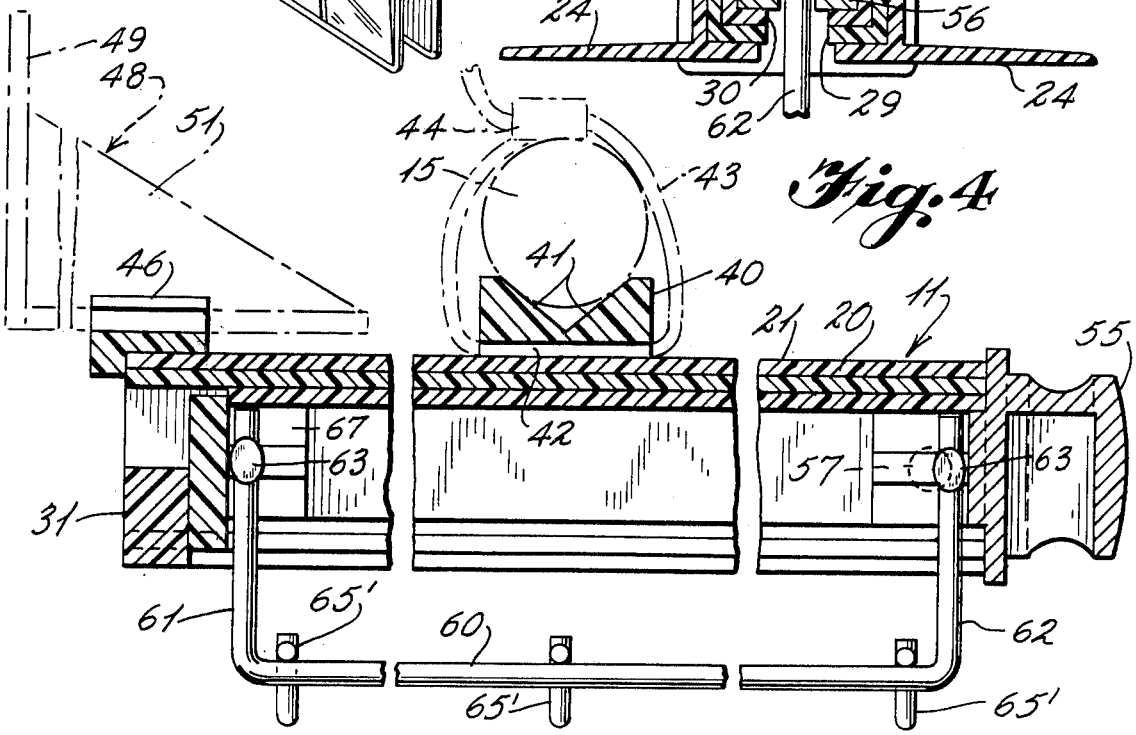
FIG. 4 is a segmented and enlarged cross sectional view of the hanger bracket and telescoping rod member of the present invention taken along line 4—4 of FIG. 3 showing the mounting means for securing the telescoping member to a closet rod.

In order to mount the extendable support member from the clothes rod 15, a first mounting member 40 is attached to the upper surface 21 of the outer housing generally intermediate the front and rear ends thereof 32 and 33, respectively. The first mounting member 40 includes beveled contacting surfaces 41 which engage the outer surface of the clothing rod 15 as shown in FIG. 4. An elongated slot 42 is provided through the length of the support member 40 and a flexible strap member 43 is extended therethrough and brought into locking engagement with itself as shown generally at 44.

The telescoping support member is further stabilized by providing a pair of opposing flange members 46 adjacent the rear wall 33 of the outer housing. The opposing flanges 46 engage either side of outwardly extending wall mounting bracket 48 which is secured to the wall W of the closet by a mounting plate 49 having fastening means 50 extending therethrough. The wall mounting bracket may be strengthened by providing an elongated flange 51 along the length thereof. As shown in FIG. 4, the opposed flange members 46 are slideably suspended from the outwardly extending portions or tracks 52 of the wall bracket 48.

Attached to the forward end of the telescoping support member is a pull knob 55. The pull knob 55 is secured to the leading end portion of the inner telescoping member 28 by means of a pair of opposing flange members 56. Each of the flange members 56 includes an outer tab portion not shown which is receivable within a generally circular opening provided through the side walls of the inner telescoping member as shown at 57.

The hanger bracket 12 is shown in detail in FIG. 4. The hanger bracket includes elongated central rod portion 60 which is bent upwardly adjacent each end thereof so as to form a pair of spaced upwardly extending rod elements 61 and 62. The rod elements 61 and 62 have a detent or keyed portion 63 adjacent the upper most ends thereof which detents are used to lock the hanger bracket to the inner telescoping support member in a manner that will be described in greater detail hereinafter. In order to selectively support the article storage bags from the telescoping support member, the hanger bracket is provided with two rows of outwardly oriented hooks 65 and 65' which are secured to the elongated bar 60 thereof. The hooks 65 should be equally spaced along the rod or bar 60 and each hook should be in back to back or aligned relationship with an opposing hook 65' so that the loads to be supported thereby are equally distributed on each side of the rod.

Figure 7:
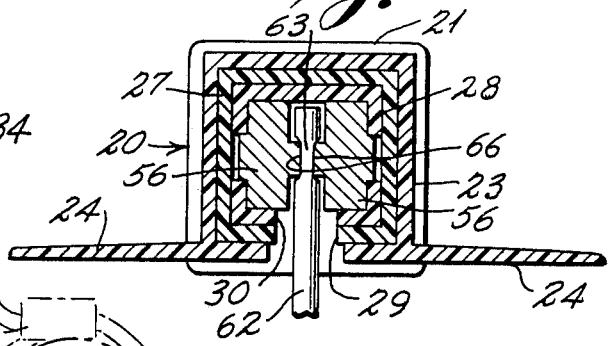
FIG. 7 is an enlarged cross sectional view taken along lines 7—7 of FIG. 3.

The hanger bracket is securely supported from the inner telescoping support member by urging the rod element 62 thereof between the flange elements 56 of the knob 55. The flange elements are provided with a pair of opposing protruding members 66 which serve to engage either side of the detents 63 of the upstanding rod portion 62 therebetween as is shown in FIG. 7. In a similar fashion, the upstanding rod element 61 is engaged between two flange members 67 which extend inwardly from the enlarged end wall of the inner telescoping member.

From the foregoing description, the hanger bracket 12 is telescopingly extended by being mounted directly to the inner telescoping member 28. The limitation upon the extent that each of the telescoping members 27 and 28 may be telescoped beyond one another insures that sufficient rigidity is maintained along the length of the telescoping support member to insure that the member does not fail due to the vertical stresses placed thereon by the loads which are supported thereby.

With particular reference to FIG. 1, a first embodiment of article clothing bags is disclosed. Each of the article clothing bags 13 and 14 includes an outer steel reinforcing frame 70 and a fabric panel cover 71 which extends across the width of the garment bags. Three eyelets 72 are provided in spaced relationship through the upper fabric panel 71 and serve to be the means by which the bags 13 or 14 are supported from the hooks 65 and 65' of the hanger bracket 12. The garment organizer bags 13 and 14 include a plurality of pockets 73. Preferably, each of the pockets 73 includes a lower article receiving portion 74 and a protective flap portion 75. Each of the flap portions 75 is secured at its uppermost end 76 so as to be in spaced relationship to the openings into the garment receiving portions 75. In this manner, enlarged articles of clothing may be placed within the pockets while permitting the flap to be extended thereover as generally shown with respect to the pocket in the lower righthand corner of the embodiment shown in FIG. 1. The flaps 75 not only prevent the contents of the pockets from being accidentally displaced therefrom, but also provide a dust cover for the articles contained or stored therein. In order to secure the flaps to the pockets, a strip of Velcro material is attached along the central portion and vertically extends along the front of each pocket as shown at 78. A cooperatively engaging Velcro strip is also attached to the inner surface portion 79 of the pocket flaps as shown at 80. Although Velcro fastening means have been disclosed, other suitable fastening means including snaps could be incorporated to secure the flaps to the pockets.

With particular reference to FIG. 2, a second embodiment of article storage bags 82 and 83 is disclosed. In this embodiment, the article storage bags differ from that of the preferred embodiment in that a plurality of open pockets 84 are provided in spaced relationship along the front of the bag with such pockets not being covered by any flaps. The pockets 85 have particular utility for supporting articles such as shoes and are therefore formed so as to taper inwardly along the length thereof being wider at the mouth 85 and narrower at their base 86. In the embodiment shown, two pair of shoes may be supported in each row of pockets 84.

It should be noted with respect to either of the embodiments of article storage bags 13 and 14 or 82 and 83, that the garment organizers of the present invention enable two such bags to be supported simultaneously from the extendable support member. As is apparent from the drawings, when two article storage bags are supported from the telescoping member by means of the hanger bracket 12, the article storage bags will be oriented with the pockets extending or opening outwardly in opposite directions. The arrangement of a bag on each side of the telescoping support member permits the weight to be distributed uniformly along either side of the rod member 60 of the hanger bracket and thereby is distributed more equally along the length of the telescoping support member.

In use of the extendable closet organizers of the present invention, the extendable support member is initially mounted to the clothes rod 15 within the closet. The wall bracket 48 is secured to the wall so as to be substantially in line with the lower portion of the clothes hanging rod 15. Thereafter, the opposed flange portions 46 mounted to the upper portion of the outer housing are brought into sliding engagement with the lower flange or track portions 52 thereof. Thereafter, the mounting block 40 is raised into engagement abutting the lower surfaces of the clothes bar 15 and the strap 43 is thereafter tightened over the top of the clothes rod and drawn into secure engagement to lock the extendable support member into mounted position.

With the extendable support member locked in position, the hanger bracket is supported by the inner telescoping member and provides two rows of opposing hooks which selectively are used to mount the article clothing bags to the extendable mounting member. An appropriate garment bag such as either 13 and 14 or 82 and 83 is thereafter mounted to the support bracket by placing the eyelets 72 thereof over the hooks 65 or 65' of the hanger bracket and thereafter permitting the garment bag to be suspended therefrom. The extendable mounting bracket is thereafter pulled outwardly by exerting a pulling force on the knob 55. In the extended position, the article clothing bags are cantilevered outwardly from beneath the clothes rod 15 and are thereby disposed into a space remote from any other articles of clothing which may be supported by the clothes rod. Articles of clothing may then be placed within pockets such as those shown at 74 and thereafter flaps brought into overlying engagement with the pockets and secured by means of the fastending means 78.

After the articles of clothing have been appropriately stored within the pockets 74 or 84, force is applied to the knob 55 to move the knob axially and urge the telescoping members 28 and 27 inwardly with respect to the outer housing 20. In use, it is preferred that two garment bags are mounted to each mounting bracket with each garment bag being disposed or oriented outwardly in an oppositely directed manner to the other clothing bag. In this manner, two article clothing bags may be supported from a single telescoping mounting member thereby further saving space and better organizing the area within the closet.

The telescoping support member is preferably constructed from an extrudable plastic with the bracket hanger member being formed of a metallic material.

The bracket hanger should be constructed so that the three sets of hooks 65 are spaced uniformly along the length of the elongated rod portion 60 thereof. Therefore, a pair of hooks should be provided adjacent each end of the rod 60 with one pair being essentially spaced intermediate thereof. Proper spacing of the hangers and hooks will insure uniform distribution of weight along the length of the extendable mounting member during use of the extendable closet organizers. The article storage bags may be constructed having a cloth or vinyl body portion with the pockets being formed of a washable pliable vinyl or cloth covered with vinyl material. In the embodiment of the invention shown in FIG. 1, it may be preferred to construct the pockets 75 and flaps 75 of a clear plastic vinyl material so that the contents thereof may be readily distinguishab therethrough.

I claim:

1. An apparatus for suspending articles of clothing from a clothes rod in a closet comprising an extendable support means, said extendable support means having a first mounting means for securing said support means to the clothes rod, said extendable support means having an outer housing and at least one telescoping member extendably carried therein and being slidable with respect thereto, a hanger means carried by said telescoping member so as to be longitudinally moveable with respect to said housing, said hanger means including an elongated rod portion having upwardly extending mounting portions at each end thereof which are engageable with said telescoping member of said support means, said elongated rod portion having a first number of pairs of spaced oppositely oriented hook means extending therefrom, a pair of oppositely oriented garment storage means, each of said garment storage means having a number of spaced engaging means equal to said first number of pairs of said hook means which are selectively engaged by said hook means so that said garment storage means are selectively suspended therefrom in a balanced relationship on opposite sides of said elongated rod portion of said hanger means, each said garment storage means having a plurality of pockets on a first side thereof for receiving articles of clothing therein, said first side of said garment storage means being oppositely oriented with respect to one another when mounted to said hook means, whereby said garment storage means are longitudinally moveable with respect to the clothes support rod by urging said telescoping menber of said extendable support means outwardly with respect thereto.

2. The apparatus of claim 1 in which each of said pockets includes a separate flap means, each of said flap means being spaced from said pockets and being selectively movable with respect thereto so as to be in overlying relationship therewith, first engaging means mounted to said pocket and second engaging means carried by said flap means, said first and second engaging means being cooperatively engaged with one another to secure said flap means to said pockets.

* * * * *